United States Patent [19]

Canez

[11] 4,237,450

[45] Dec. 2, 1980

[54] APPLIANCE THEFT ALARM

[76] Inventor: Antonio R. Canez, 1210 W. Siglo Pl., Tucson, Ariz. 85705

[21] Appl. No.: 959,697

[22] Filed: Nov. 13, 1978

[51] Int. Cl.[3] ..... G08B 13/14

[52] U.S. Cl. ..... 340/571; 340/568

[58] Field of Search ..... 340/568, 571

[56] References Cited

U.S. PATENT DOCUMENTS

| | | | |
|---|---|---|---|
| 3,192,518 | 6/1965 | Sliman | 340/568 |
| 3,289,194 | 11/1966 | King | 340/571 |
| 3,484,775 | 12/1969 | Cline | 340/568 |
| 3,553,673 | 1/1971 | Fistell | 340/571 |
| 3,794,989 | 2/1974 | Manley et al. | 340/572 |
| 3,836,901 | 9/1974 | Matto et al. | 340/571 X |
| 4,028,691 | 6/1977 | Zeder | 340/568 |
| 4,075,617 | 2/1978 | Wireman | 340/687 |

*Primary Examiner*—Alvin H. Waring

*Attorney, Agent, or Firm*—J. Michael McClanahan

[57] ABSTRACT

An appliance theft alarm for mounting on or inside an electrical appliance which, when the electrical plug connecting the appliance with a wall electrical outlet is removed, will sound an audible alarm in order that the theft may be detected.

Specifically, electrical apparatus is interconnected so that the electrical power cord running between the electrical appliance and the electrical wall outlet is sensed for the presence of electrical voltage, where when the electrical voltage is present, a relay is energized to inhibit the alarm circuit. When electrical voltage is removed, the relay becomes unenergized and in doing so, completes an electrical circuit for a self-contained battery to power an electrical horn or siren alarm. The battery is provided with a battery charger which is supplied ac current from the electrical line input. Additionally, a key controlled contact is provided to inhibit the alarm circuitry when desired or to interrupt the alarm when sounding. Relay lock-up means are also provided to prevent the alarm from being turned off, once sounded, by merely replugging the appliance's electrical plug into the wall.

7 Claims, 2 Drawing Figures

APPLIANCE THEFT ALARM

BACKGROUND OF THE INVENTION

In the times of today, the public is very conscious of the theft of goods from houses and businesses. To a large extent, these thefts are concentrated in electrical appliances of entertainment nature, such as television sets, radios, phonographs, stereo systems, and the like. One feature that all these types of appliances share is that they are connected with a source of power through the usual means of a power cord which plugs into a wall outlet. And, in order to steal the electrical appliance a thief will have to remove the electrical power cord from the wall or pull the power cord out. Thus sensing the removal of available power to an electrical appliance is a means to detect the beginnings of the theft of the appliance.

To this end, many burglar type devices have been devised which sense the physical removal of the electrical plug at the electrical outlet, but none have been devised for detection at the appliance itself and more particularly, having an alarm located on the appliance itself, the alarm also being supplied energy for storage from a source independent of the electrical wall circuit.

For example, burglar type alarm means have already been invented where there is a mchanical interruption of an electrical circuit by sensing the presence of the electrical plug at the wall outlet. In these cases, removal of the electrical plug from the wall socket mechanically interrupts or engages electrical contacts and indication is made at a central control room. This is shown in United States Patents to Cline, U.S. Pat. No. 3,484,775; Sliman, U.S. Pat. No. 3,192,518; and Zeder, U.S. Pat. No. 4,028,691.

Other known burglar type alarm systems dealing with electrical connection at the wall socket are shown in the patents of Manley, et al, U.S. Pat. No. 3,794,989, and Wireman, U.S. Pat. No. 4,075,617, which depend upon electrical connection through the grounding plug of a three wire electrical plug to detect removal of the ac power to the appliance.

While these prior described inventions will detect the removal of the electrical plug from the wall outlet, it is not hard to visualize a situation where the thief may remove the appliance before a person could respond to the alarm, and when the parties responding did arrive, they would find nothing.

Thus it is apparent there is need for an alarm which will attach to the appliance itself, will sound when the appliance is stolen, and which will enable the owner of the appliance, or other parties, to ascertain the location of the appliance during the process of the theft.

SUMMARY OF THE INVENTION

The present invention comprises electrical apparatus which is located on or inside an electrical appliance to sound alarm if the electrical appliance is removed when unauthorized. The invention operates by sensing the absence of the normally present electrical energy in the electrical cord connecting the appliance to the source of electrical power. Upon the interruption of the electrical power, which would initiate the theft of the electrical appliance, a normally energized relay is switched to the unenergized state which in turn energizes an electrical horn or siren powered by a self-contained battery internal to the alarm system.

Means are provided to override the alarm or to inhibit the alarm through a key controlled contact system. Additionally, through means of a lock up relay, the alarm may not be turned off by merely replugging the electrical plug into the wall socket.

Alternately, for the case of electrical appliances which are audio in nature, i.e., having a loudspeaker, means are provided to substitute the horn or alarm system of the preferred embodiment with an electrical oscillator and relay to connect to the appliance's loudspeaker in order that the alarm be sounded through that loudspeaker.

Thus the generation of the alarm signal will tend to deter the stealing of the electrical appliance or, if the thief continues the theft and carries the appliance around, the sound emanating from the alarm system on the appliance will give notice.

Accordingly, it is an object of the present invention to provide an alarm system for electrical appliances where the alarm is carred by the appliance itself.

Further, it is another object of the present invention to provide an alarm system for electrical appliances which detects the removal of electrical power to the appliance.

A further object of the subject invention is to provide an alarm system for an electrical appliance detecting the removal of electrical power, which alarm may not be turned off by the restoration of electrical power.

It is still a further object of the subject invention to provide an alarm system for an electrical appliance where the alarm may be controlled by a keyed contact.

DETAILED DESCRIPTION OF THE PREFERRED EMBODIMENT

Figure 1:
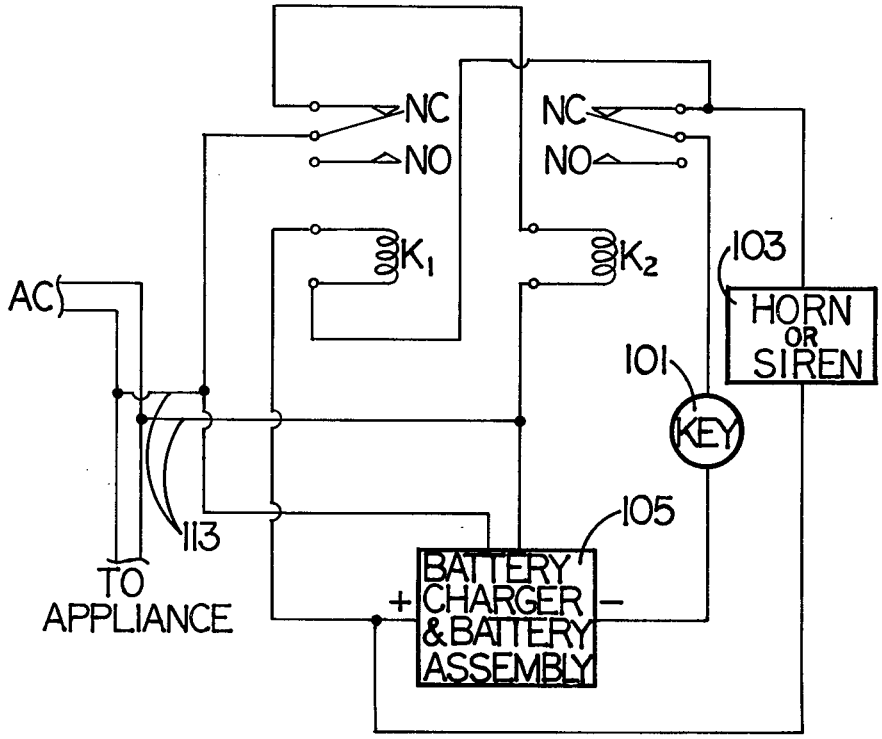
FIG. 1 is a functional block diagram/electrical schematic of the preferred embodiment of the subject electrical appliance theft alarm.

Applicant's device is detailed in the modified block diagram/electrical schematic diagram shown in FIG. 1. Basically the invention comprises five basic parts, namely relays K1 and K2, key controlled contact 101, siren or horn 103 and battery charger and battery assembly 105, all of which are interconnected by electrical wiring as set out in the schematic portion of FIG. 1. As can be seen, both normal 110 volt alternating current house electricity is utilized as well as the direct current battery supplied electricity.

Explanation of the connections between the various elements shown in FIG. 1 will be detailed in the description of the operation and function of the invention as follows. FIG. 1 shows the circuit with no power energizing any relay nor a completed battery output circuit. This may be easily accomplished by having key controlled contact 101 switched to the off position.

The invention is mounted upon or in the internal cavity of the electrical appliance, such as a television set. The invention taps onto the electrical lead line at a point before the lead line reaches the appliance on/off switch. This may be accomplished in one of a number of methods, not the least of by cutting into the electrical lead line to make connection or by puncturing the outside insulation to make the electrical contact. Or, the electrical ac lead in cord may be tapped at the electrical socket which generally mounts upon the back of the television set. In this case, the tap would be made inside the appliance cavity. These ac tapping wires 113 connect directly to the battery charger and battery assembly 105 which keeps the battery there inside charged for supplying of the dc current to the circuit. In addition, one of the pair of ac lead in wires 113 also connects to the switch contact of relay K1. The other ac inlet wire of pair 113 connects to one side of the coil of relay K2.

Continuing, the other side of the coil of relay K2 connects with the normally closed (NC) contact of relay K1. This completes a circuit for the coil of relay K2 which pulls in the switch contact of the relay K2 to the normally open contact when power is on the ac line. Thus relay K2 will be energized during the period of time that the appliance ac cord is plugged into the wall outlet.

Since in the normal configuration, key 101 will be turned on and the electrical cord is energized, direct current may pass through the key 101 to the switch contact of relay K2 but, travels no farther since the normally open (NO) contact of that relay is unconnected. In this position the horn or siren 103 is silent as there is no electrical continuity from the battery terminal through the key, through the switch contact, and through the normally closed (NC) contact of relay K2.

Now, in the event that a thief wishes to steal the appliance from a person's home, the first movement of the thief is to unplug the electrical inlet cord from the wall. At this time the ac power is removed from ac inlet wires 113. The very first thing that will happen is relay K2, which heretofore was energized, will become unenergized and allow the switch contact to swing to the upper, normally closed (NC) contact of the relay K2 assembly. At this point, battery current is supplied through key controlled contact 101, which is closed, through the switch contact and normally closed (NC) contact of relay K2, to the horn or siren, and then back to the other terminal of the battery.

The horn or siren now will immediately begin its alarm and deter the thief from picking up the appliance and carrying it outside the residence. The horn or siren will continue to sound so long as there remains electrical energy in the battery and the key controlled contact 101 has not been shut off. When the owner discovers the theft by hearing the alarm, they may come in and shut off the alarm by inserting the key into the key contact and turning the key off. This interrupts the closed circuit for the horn.

It is noted that when the a.c. power is removed from the invention, the battery, in addition to supplying current for the horn or siren alarm, also supplies current to the coil of relay K1 which immediately closes the contacts of this relay. This pulls the switch contact of relay K1 from the normally closed (NC) to the normally open (NO) position and interrupts the a.c. path for the coil of relay K2. The purpose of this is to prevent the thief from immediately replugging the a.c. line back into the wall and stop the siren or horn alarm from sounding. This is the lock-up or latch-up feature for the sounding of the alarm, the relay K1 commonly called the latch-up relay.

Suppose now that the owner wishes to deactivate the alarm and plug the appliance cord back into the wall, assuming at this point that the thief had activated the alarm, had left the premises, and the owner has turned the alarm off by turning the key controlled contact 101 to the off position. When the key is turned off, relay K1 will be de-energized permitting its relay switch contact to swing to the normally closed (NC) position. At this point in time, the coil of relay K2 is put into a completed electrical circuit awaiting the application of alternating current voltage. Then, when ac current is supplied to the ac lead-in wires 113, relay K2 energizes and pulls the switch contact to the noramlly open (NO) position. This provides for a second break in the electrical circuit from the battery of assembly 105 and the key controlled switch now may be rotated to its on position. The horn or siren does not come on. The invention now is back to its normal ready state.

In the event that a person wishes to remove the cord from the wall, such as to move the appliance around, all the party need do is place the key in the key controlled contact 101 and rotate it to the off position. This inhibits the alarm horn system by breaking electrical contact with one side of the battery.

Now it is noted that if it is desired to check the alarm system, such as before the set power cord is plugged into the wall, all one need do is momentarily turn the key controlled contact 101 from its resting off position to a on position. The alarm will sound so long as the contact is on and the battery is charged.

While above it was assumed that the television set was turned off, it is realized that the invention operates off the ac line prior to the on/off switch on the appliance, so that the appliance can be turned on without interruption of the normal function as described above of the subject inventive alarm system.

Figure 2:
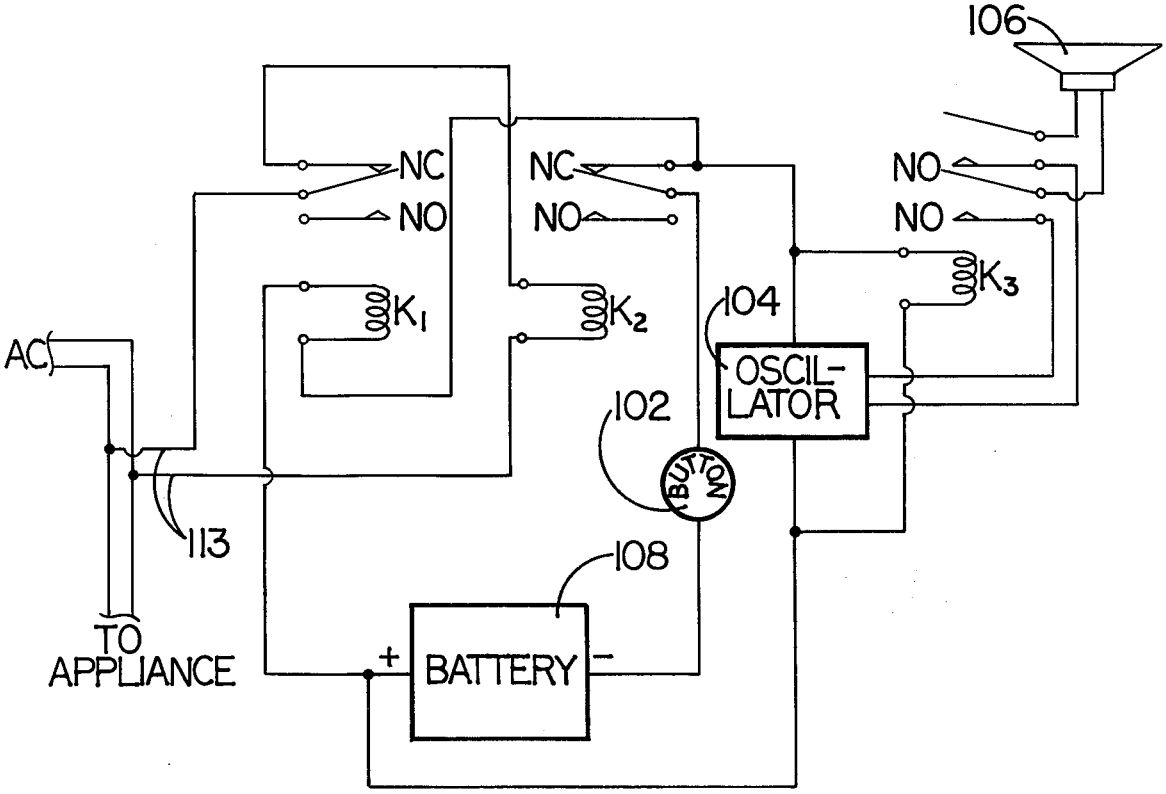
FIG. 2 is a functional block diagram/electrical schematic of an alternate embodiment of the subject appliance theft alarm for application to electrical appliances which have loudspeakers.

Now while in the preferred embodiment, a horn or siren is utilized as the alarm device, many electrical appliances which a person might wish to protect are appliances of the nature that have a loud speaker system as a part thereof, for example, a television set, radio, stereo system, or the like. Thus it is obvious that the Applicant's invention would well work through the loudspeaker of the audio system of the appliance. FIG. 2 is an alternate embodiment of the Applicant's invention where a change has been made by replacing the horn or siren 103 with an electrical oscillator 104 or other electrical generation system for generating signals to the appliance loudspeaker. As can be seen in the functional block/electrical schematic diagram of FIG. 2, the output of the oscillator or other electrical signal generator 104 is operably connected to the loudspeaker 106 of the appliance which is desired to be protected. It is noted that relay K3 has been placed in the electrical circuit between oscillator 104 and loudspeaker 106 in order to provide isolation of the alarm system from the electrical appliance audio circuit. In this configuration, isolation relay K3 will close only when the alarm system is activated as it receives its coil energizing power at the same time that power is supplied to the oscillator. With the type of oscillators that are currently available, a tone or alarm signal as desired may be presented the loudspeaker 106 to sound the alarm. In addition, other changes have been made in the preferred embodiment shown in FIG. 1, in order to conserve on cost, and realizing that the alarm system is the only real drain upon the stored energy, the battery charger and battery assembly 105 of the preferred embodiment has been replaced with battery 108, the previously a.c. power lines supplying the battery charger, having been removed. Also, key contact 101 has been changed to a push button type contact switch, commercially available, where on successive pushes by an operator, the switch 102 will alternately turn off, then on, then off, etc.

Now it is realized that the components which are shown in the alternate embodiment maybe substituted for the similar component shown in the preferred embodiment, either singly, or in any combination as electrically, they perform identical or similar functions as far as the operation of this circuit is concerned.

All of the components which have been utilized in Applicant's invention are currently available commercial units, for example, the following listed parts were incorporated into the Applicant's construction of his device. Relays K1 and K3 are Potter and Brumfield, DPDT, 6 VDC, Model KA11DY; relay K2 is Potter and Brumfield, DPDT, 120 VAC, Model KA11AY; key contact 101 is manufactured by Archer, SPST Lock Switch, Model 275-503; horn or siren 103 is Minisiren, GC Electronics, No. 30-9120; battery charger and battery assembly 105 is Energel, No. 23-129 and No. 23-128; oscillator 104 is an astable multi-vibrator well-known in the field, such as that one illustrated in the General Electric Transistor Manual, Sixth Edition, at page 170; battery 108 is a standard 6VDC battery; and push button 102 is Cutler Hammer, 1PDT, Push-Push, Model SA41SEW1.

While a preferred embodiment and one alternate embodiment has been shown and described in detail, there are obviously many other embodiments and variations and configurations which may be made by a person skilled in the art without departing from the spirit, scope, or principal of this invention. Therefore, this invention is not to be limited except in accordance with the scope of the appended claims.

I claim:

1. An electrical appliance theft alarm for installation on an appliance for detection of the removal of the electrical power through the appliance associated electrical power cord from an electrical power source comprising a warning sound device an electrical battery for powering said warning sound device, and a first relay and a latch-up relay, both said first relay and latch-up relay having an electromagnetic energizing coil and responding normally open and normally closed contacts, said first relay coil operably connected to said associated appliance power cord through said latch-up relay normally closed contact, and said first relay normally closed contact operably connected between said electrical battery and said warning sound device, said latch-up relay coil operably connected to said battery through said first relay normally closed contact whereby said first relay coil is continually energized by the outside electrical power source and the warning device inhibited, but when the outside electrical power source is removed from the appliance, said warning device is activated by said electrical battery through said first relay normally closed contacts and said latch-up relay coil is also energized and thereby removes said first relay coil from the outside power source in order that the re-application of power to the appliance's electrical power cord does not shut off the warning device.

2. The electrical appliance theft alarm as defined in claim 1 further including key contact means operably connected between said first relay and said electrical battery, said key contact means adapted to make and break electrical contact by insertion and turning of a key whereby the electrical connection between said electrical battery and said first relay may be interrupted by keying said key contact means off and thereby inactivating the alarm.

3. The electrical appliance theft alarm as defined in claim 1 wherein said electrical battery includes electrical battery charger and an electrical battery, said electrical battery charger operably connected to the appliance associated electrical power cord, and said electrical battery operably connected to said electrical battery charger.

4. The electrical appliance theft alarm as defined in claim 1 wherein said warning sound device comprises an electrically actuated siren.

5. The electrical appliance theft alarm as defined in claim 1 wherein said warning sound device comprises an electrically actuated audio horn.

6. The electrical appliance theft alarm as defined in claim 1 wherein said warning sound device comprises electrical oscillator and electrical loudspeaker, said electrical oscillator operably connected to said loudspeaker whereby when electrical power is removed from the appliance, said oscillator will generate an electrical signal which is supplied to the loudspeaker sounding an alarm.

7. The electrical appliance theft alarm as defined in claim 6 wherein said warning sound device additionally includes isolation relay, said isolation relay operably connected between said electrical oscillator and said electrical loudspeaker, said isolation relay also operably connected to said electrical relay whereby said isolation relay permits connection between said electrical oscillator and said electrical loudspeaker when said oscillator generates an electrical signal to be supplied to said electrical loudspeaker.

* * * * *